US005394479A

United States Patent [19]

Ishigaya et al.

[11] Patent Number: 5,394,479

[45] Date of Patent: Feb. 28, 1995

[54] SOUNDING APPARATUS WITH SURFACE MOUNTING TERMINALS

[75] Inventors: Shoji Ishigaya; Isao Fushimi, both of Shizuoka, Japan

[73] Assignee: Star Micronics Co., Ltd., Shizuoka, Japan

[21] Appl. No.: 142,840

[22] Filed: Oct. 25, 1993

Related U.S. Application Data

[63] Continuation of Ser. No. 927,544, Aug. 5, 1992, abandoned, which is a continuation of Ser. No. 750,433, Aug. 20, 1991, abandoned, which is a continuation of Ser. No. 383,414, Jul. 20, 1989, abandoned.

[30] Foreign Application Priority Data

Jul. 25, 1988 [JP] Japan ..... 63-185061

[51] Int. Cl.[6] ..... H04R 25/00

[52] U.S. Cl. ..... 381/188; 381/192; 381/199; 381/201; 381/205

[58] Field of Search ..... 381/188, 205, 192, 193, 381/199, 203, 88, 201, 87, 171, 200; 340/388, 391, 404

[56] References Cited

U.S. PATENT DOCUMENTS

| | | | |
|---|---|---|---|
| 2,754,373 | 7/1956 | Shaper | 381/187 |
| 3,887,914 | 6/1975 | Sato et al. | 340/391 |
| 4,013,846 | 3/1977 | Krawczak et al. | 381/203 |
| 4,050,066 | 9/1977 | Yanagisawa et al. | 340/388 |
| 4,075,626 | 2/1978 | Sakaguchi et al. | 340/388 |
| 4,097,861 | 6/1978 | Pariza | 340/388 |
| 4,163,223 | 7/1979 | Sato et al. | 340/388 |
| 4,175,262 | 11/1979 | Harakawa et al. | 340/388 |
| 4,251,807 | 2/1981 | Hofer et al. | 340/388 |
| 4,399,334 | 8/1983 | Kakiuchi et al. | 381/199 |
| 4,578,808 | 3/1986 | West | 381/200 |
| 4,926,398 | 5/1990 | Fincher | 381/169 |

FOREIGN PATENT DOCUMENTS

| | | | |
|---|---|---|---|
| 55-113598 | 8/1980 | Japan | G10K 9/13 |
| 60-26099 | 2/1985 | Japan | G10K 9/22 |
| 61-183568 | 11/1986 | Japan | H05K 1/18 |
| 63-22795 | 6/1988 | Japan | H04R 13/00 |
| 63-133797 | 9/1988 | Japan | H04R 13/00 |

*Primary Examiner*—Curtis Kuntz
*Assistant Examiner*—Jason Chan
*Attorney, Agent, or Firm*—Koda and Androlia

[57] ABSTRACT

The present invention provides a sounding apparatus with surface-mountable terminals, the sounding apparatus being capable of being automatically assembled onto a printed circuit board by the use of surface-mounting method. The sounding apparatus is formed by joining a molded housing including a pole piece and surface-mountable terminals to a container having sound emitting ports formed therein. A bobbin about which a magnet wire is wound is mounted on the pole piece of the housing and serves to actuate a vibrating plate spaced therefrom by a predetermined distance under the action of magnetic force. The bobbin includes bobbin terminals electrically connected with the terminations of the magnetic wire. When the bobbin is mounted on the pole piece, the bobbin terminals are brought into contact with the surface-mountable terminals on the housing so that the magnet wire on the bobbin will be electrically connected with the surface-mountable terminals.

6 Claims, 8 Drawing Sheets

SOUNDING APPARATUS WITH SURFACE MOUNTING TERMINALS

This is a continuation of application Ser. No. 07/927,544, filed Aug. 5, 1992, now abandoned, which is a continuation of application Ser. No. 07/750,433, filed Aug. 20, 1991 , now abandoned, which is a continuation of application Ser. No. 07/383,414, filed Jul. 20, 1989, now abandoned.

BACKGROUND OF THE INVENTION

1. Field of the Invention

The present invention relates to a sounding apparatus for generating a sound, comprising a vibrating plate actuated by a magnetic field from an exciting coil or a resonant plate hit and vibrated by such a vibrating plate.

2. Description of the Prior Art

Recent development of automatic assembly has enabled electronic parts to be automatically mounted on printed circuit boards. The electronic parts to be mounted have been increasingly reduced in size and also electronic small-sized parts as called chip parts suitable for the automatic assembly have been used more currently. On mounting a chip part on a printed circuit board, a solder paste is applied to a portion of the printed circuit board on which the chip part is to be mounted. The chip part is then placed on the portion of the printed circuit board to which the solder paste was applied. When heated to a raised temperature at which the solder is fused, for example, at about 240° C., the chip part will be soldered to the printed circuit board in a so-called "surface mounting" manner. Even in the field of sounding bodies, it is required that the sounding bodies can be automatically mounted on substrates in the "surface-mounting" manner, as in the chip parts.

In the past, the sounding instrument is first held by an automatic part inserting device. The terminals of the sounding instrument electrically connected with an exciting coil are then inserted into the corresponding mounting portions of a printed circuit board, such as through-holes formed therein. Finally, the sounding instrument are securely mounted on the printed circuit board after the above assembly has been dip soldered. However, the automatic surface-mounting and assembling system as described above cannot be used in surface-mounting the sounding instrument on the printed circuit board. This raises a problem in that the assembling of the sounding instruments cannot be efficiently made.

SUMMARY OF THE INVENTION

It is therefore an object of the present invention to provide a sounding apparatus which can be adapted to the surface-mounting process and which can be automatically assembled by the use of an automatic surface-mounting and assembling system.

To this end, the present invention provides an sounding apparatus which comprises a housing molded of a high-temperature resin and including a pole piece and surface-mounting terminals, a bobbin mounted in the housing and having bobbin terminals each connected with the corresponding termination of a coil about which a magnet wire is wound, said bobbin being adapted to actuate a vibrating plate under the action of magnetic force, each of said bobbin terminals being electrically connected with the corresponding one of said surface-mounting terminal, and said housing being joined to a container having sound emitting ports.

In such an arrangement, the sounding apparatus can be adapted to the surface-mounting process and automatically assembled by the use of an automatic surface-mounting and assembling system to which the surface-mounting process is applied.

DETAILED DESCRIPTION OF THE PREFERRED EMBODIMENTS

Figure 1:
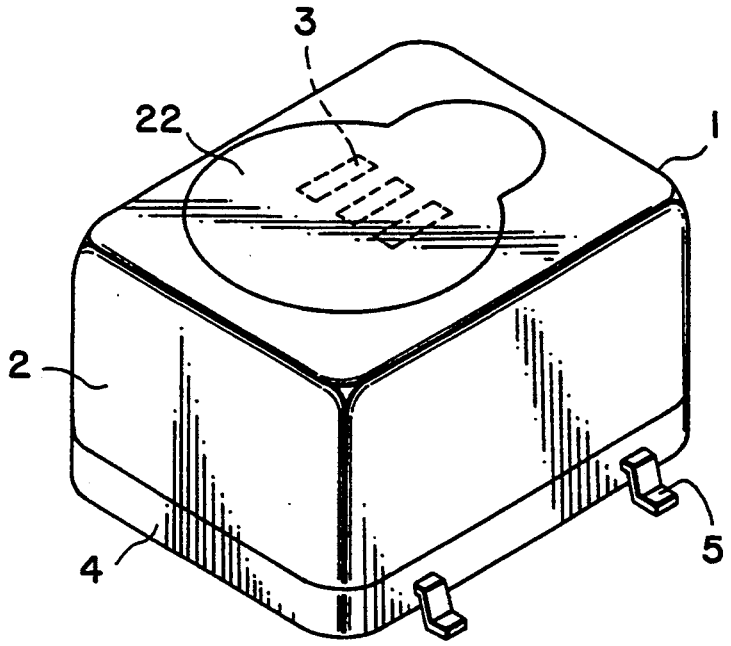
FIG. 1 is a perspective view of one embodiment of a speaker-shaped sounding apparatus constructed in accordance with the present invention.

The present invention will now be described in detail in connection with some embodiments thereof illustrated in the drawings.

In general, the sounding apparatus may be classified into a speaker type in which a vibrating plate is actuated to generate a sound and a hitting type in which a resonant plate is hit and vibrated to generate a sound.

Figure 3:
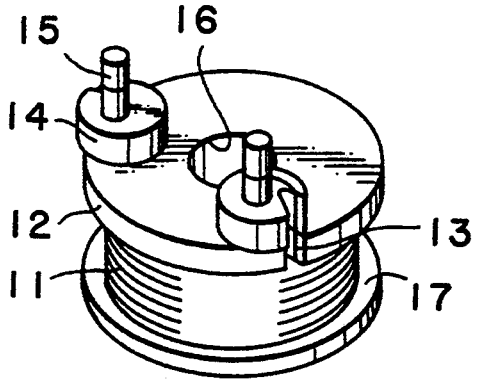
FIG. 3 is a perspective view of the bobbin 17.
Figure 2A:
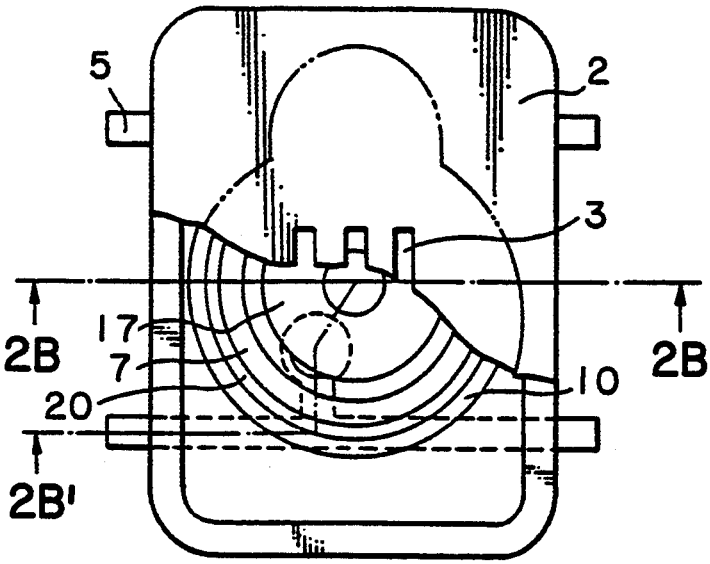
FIG. 2A is a plan view, partially broken away, of the sounding apparatus shown in FIG. 1.
Figure 2B:
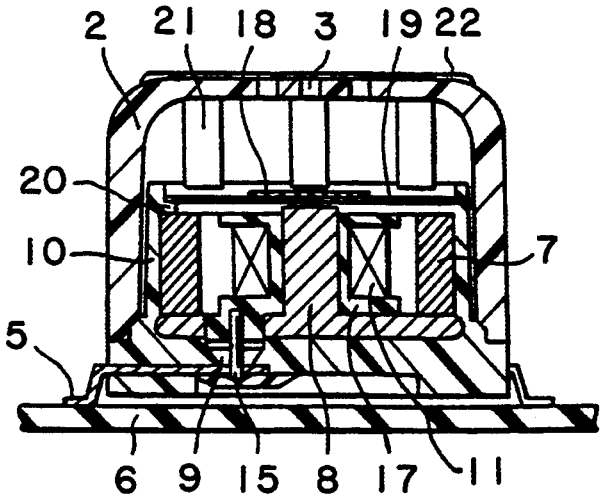
FIG. 2B is a cross-sectional view having a section taken along a line 2B—2B in FIG. 2A overlapped by another section taken along a line 2B', in the same figure, showing the sounding apparatus placed on a printed circuit board.
Figure 2C:
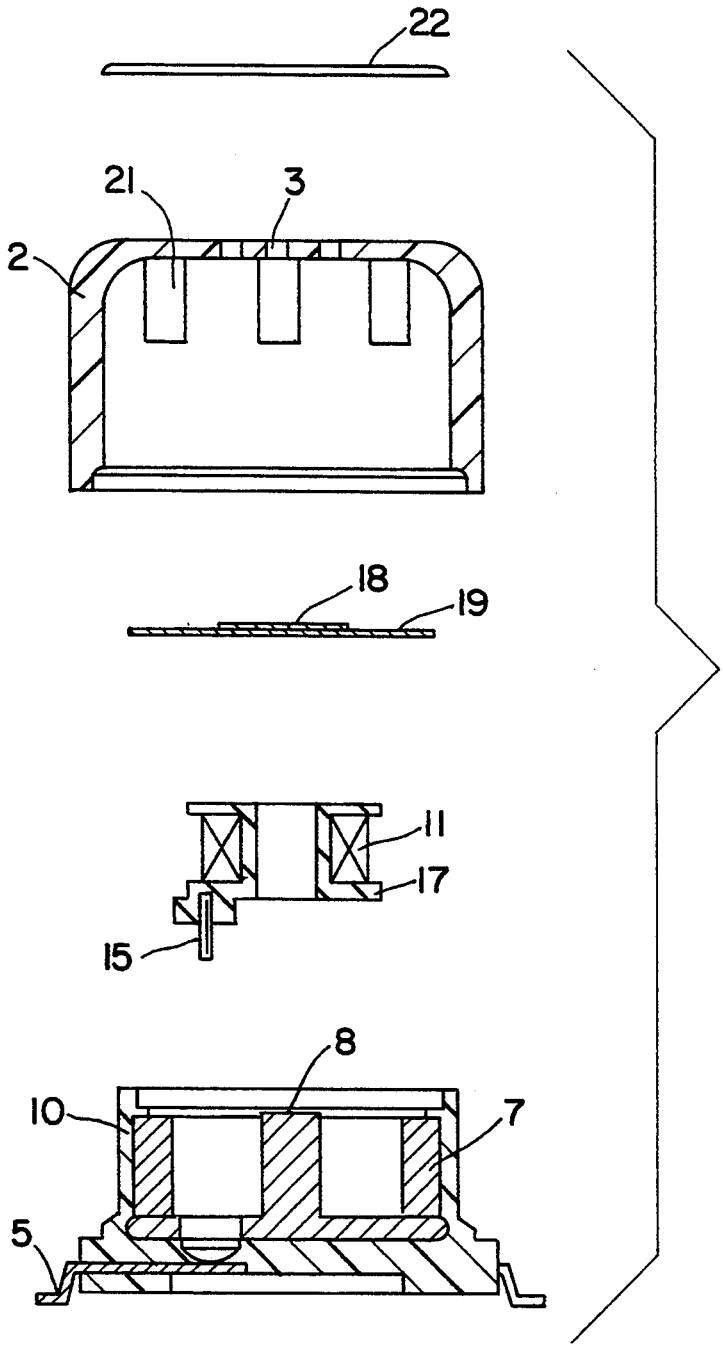
FIG. 2C is an exploded view of the cross-sectional view of FIG. 2B.

Referring now to FIGS. 1 to 3, there is shown a speaker type sounding apparatus which is the first embodiment of the present invention.

FIG. 1 is a perspective view showing the outline of a sounding apparatus 1. The sounding apparatus 1 comprises a container 2 having a sound emitting port 3 formed therein and a housing 10 including surface-mounting terminals 5 and other parts, the container and housing being securely joined to each other.

FIG. 2A is a plan view, partially broken away, of the speaker type sounding apparatus 1 while FIG. 2B is a cross-sectional view showing the sounding apparatus 1 placed on a printed circuit board 6. In connection with these figures, the construction of the speaker type sounding apparatus will be described below in detail.

The surface-mounting terminals 5 which each comprise a bent, electrically conducted metal strip serve to solder the housing 10 on the pattern surface of a printed circuit board 6 in the surface-mounting manner.

The sounding apparatus further comprises a pole piece 8 adapted to complete a closed circuit together with a magnetic force from a magnet 7 and another magnetic force created as the magnet wire wound about a bobbin 17, which will be described hereinafter, is energized.

The housing 10 is molded of a high heat-resistant resin having low thermal expansion coefficient and formed to expose a part of the top end of the magnet 7 therein such that a gap between the top end of the magnet 7 and the top end of a support 20 supporting a vibrating plate 19 can be determined in dimensional accuracy.

FIG. 3 is a perspective view showing the detail of the bobbin 17 which includes a through-hole 16 formed therethrough at the central portion. The through-hole 16 is adapted to receive the projection of the aforementioned pole piece 8.

The bobbin 17 includes a magnet wire 11 of a special copper having a high heat-resistance which is wound about the side of the bobbin 17. Each of the terminations of the magnet wire 11 extends outwardly through the corresponding one of notches 13 in one bobbin flange 12 and is soldered to the corresponding one of bobbin terminals 15 press fitted into the top hole of the respective one of protrusions 14 on the bobbin flange 12.

When the bobbin 17 is to be mounted in the housing 10, the projection of the pole piece 8 in the housing 10 is inserted into the through-hole 16 of the bobbin 17 while at the same time the protrusions 14 on the bobbin 17 are press fitted into the respective openings 9 formed in the housing 10 at its bottom. Each of the surface-mounting terminals 5 is then brought into contact with the corresponding one of the bobbin terminals 15 to which the terminations of the magnet wire 11 are soldered. After the respective surface-mounted terminals 5 have been soldered to the bobbin terminals 15, the soldered sections are sealed with any suitable plastic material such as epoxy resin.

Vibrating plate 19 is placed on the support 20 formed on the inner wall of the housing 10 adjacent to the top end thereof and adapted to be actuated under the magnetic action which a magnetic element 18 thereon receives.

The pole piece 8 having an inverted T-shaped cross-section may be molded into a single body or formed by joining a rod-like element on a disc-like base. The vibrating plate 19 may be made of a non-magnetic material except the magnetic element 18 thereon.

The container 2 will now be described. The container 2 is made of a high heat-resistant molding resin and includes sound emitting ports 3 formed therein at the closed top and a plurality of stoppers 21 extending inwardly from the inner wall of the closed top.

Each of the stoppers 21 may be provided with one or more side ribs for increasing the strength thereof. In place of these stoppers 21, a plurality of ribs may be formed on the inner wall of the closed container top with each rib having an inwardly extending projection.

After the housing 10 is placed within the container 2, they are rigidly joined to each other by any suitable joining means such as ultrasonic welding. At this time, the lower end face of each of the stoppers 21 (or the lower end face of each of the projections of the ribs) on the closed container top wall is positioned slightly above the top end portion of the housing 10 without contacting the vibrating plate 19. In such an assembly, the stoppers 21 prevent the vibrating plate 19 from being fallen as by an external impact.

Figure 4A:
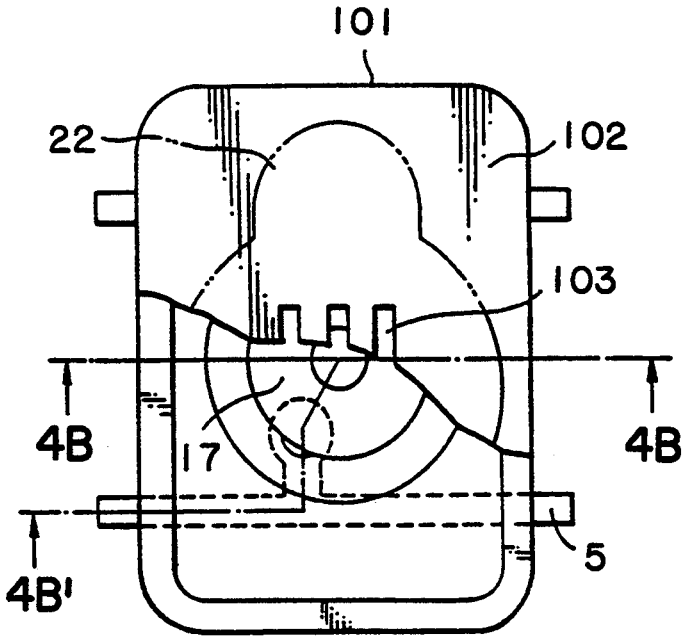
FIG. 4A is a plan view, partially broken away, of a hitting type sounding apparatus which is the second embodiment of the present invention.
Figure 4B:
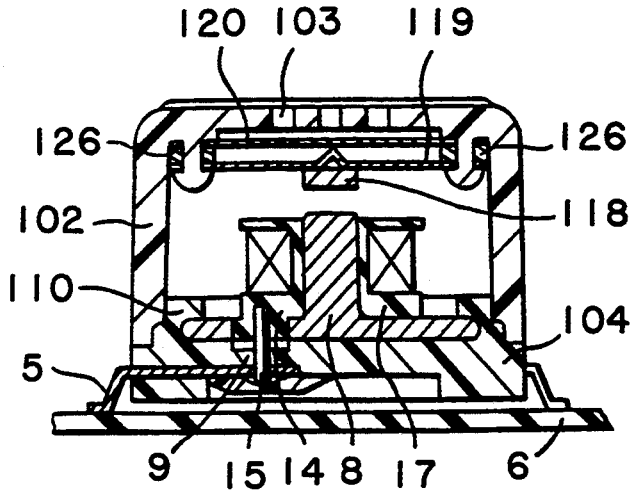
FIG. 4B is a cross-sectional view having a section taken along a line 4B—4B in FIG. 4A overlapped by another section taken along a line 4B' in the same figure, showing the sounding apparatus placed on a printed circuit board.
Figure 4C:
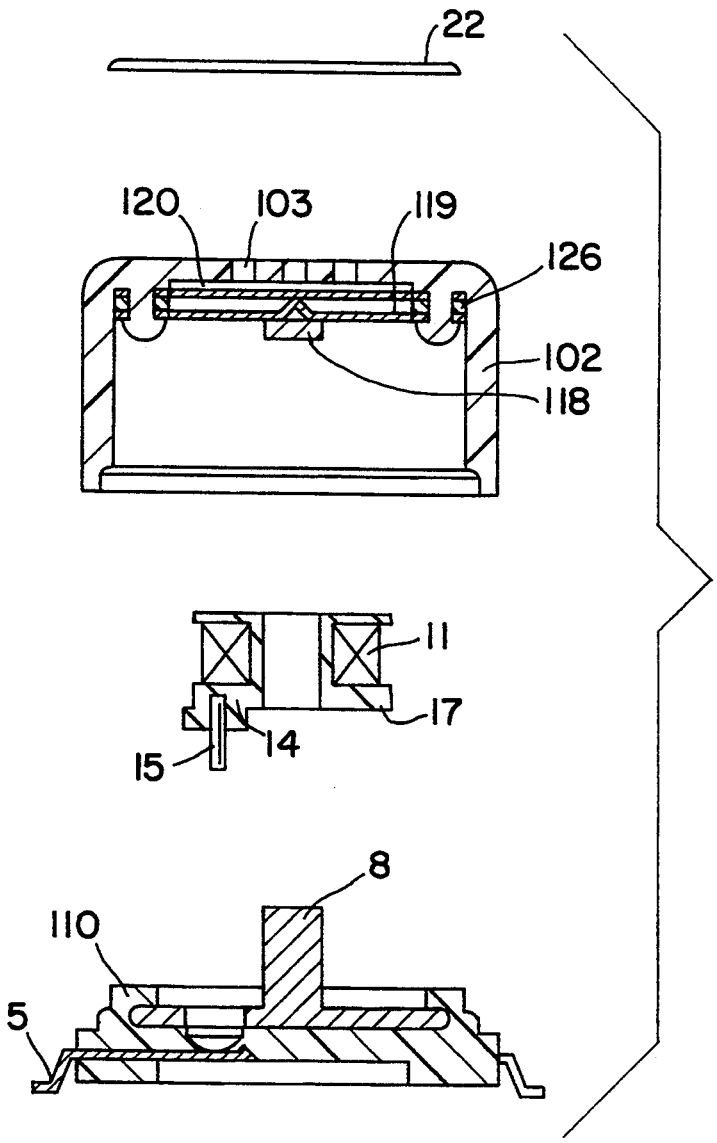
FIG. 4C is an exploded view of the cross-sectional view of FIG. 4B.

FIG. 4A is a plan view of a hitting type sounding apparatus 101 which is the second embodiment of the present invention, with part of a container 102 being broken away for clarity while FIG. 4B is a cross-sectional view of the sounding apparatus 101 mounted on a printed circuit board 6. The sounding apparatus 101 will now be described in conjunction with these figures.

The sounding apparatus 101 comprises surface-mounting terminals 5 each of which serves to mount the sounding apparatus 101 on the pattern surface of the printed circuit board 6 in the surface-mounting manner and a pole piece 8 adapted to complete a closed circuit together with a magneticity created as the magnet wire wound about a bobbin 17, which will be described hereinafter, is energized.

As in the first embodiment, the bobbin 17 includes a through-hole 16 formed therethrough, which is adapted to receive the projection of the pole piece 8 in the housing 110. The bobbin 17 also includes protrusions 14 each of which will be press fitted into the corresponding one of openings 9 formed in the inner wall of the bottom of the housing 110 on assembling.

The bobbin 17 further includes bobbin terminals 15 soldered to the terminations of the magnet wire 11 wound about the bobbin 17. Each of the bobbin terminals 15 is brought into contact with the corresponding one of the surface-mounting terminals 5. The contacted sections are then soldered to each other and finally sealed with any suitable plastic material such as epoxy resin.

The sounding apparatus further comprises a container 102 which holds, at its closed top, a vibrating plate 119 having a permanent magnet 118 and a resonating plate 120. These plates 119 and 120 are maintained spaced apart from each other through spacer means 126.

When the magnet wire 11 is energized, a magnetic field is created to actuate the vibrating plate 119 which in turn hits the resonating plate 120 to generate a sound. The sound will be emitted outwardly through sound emitting ports 103 formed in the closed top wall of the container 102.

After the housing 110 is mounted within the container 102, they are rigidly joined to each other by any suitable joining means such as ultrasonic welding.

Figure 6:
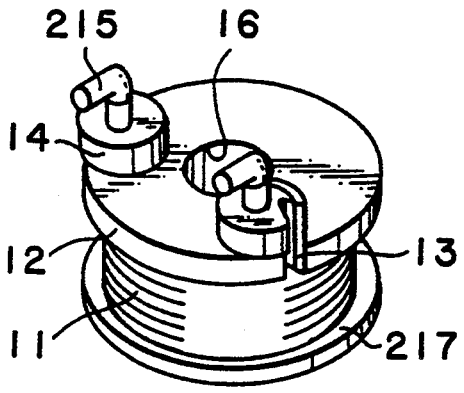
FIG. 6 is a perspective view of the bobbin 217.
Figure 5A:
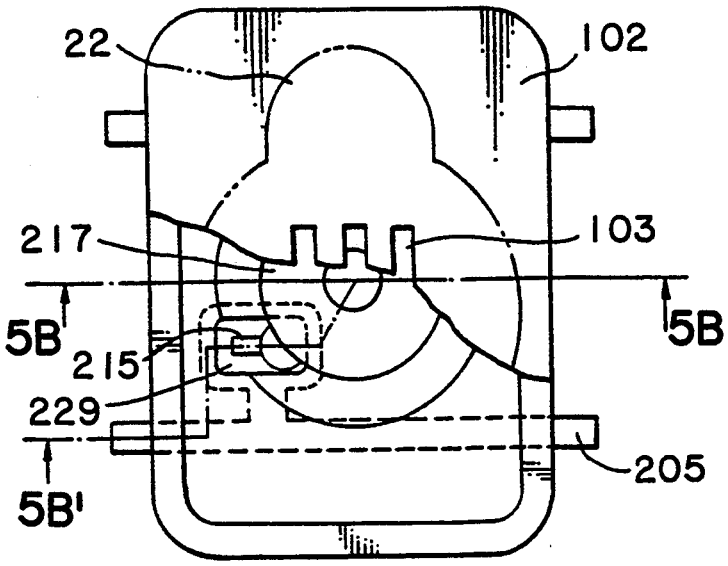
FIG. 5A is a plan view, partially broken away, of a hitting type sounding apparatus which is the third embodiment of the present invention.
Figure 5B:
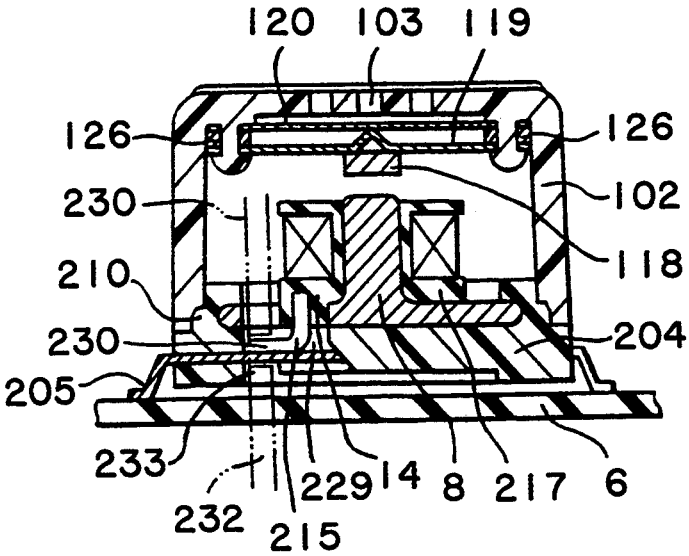
FIG. 5B is a cross-sectional view having a section taken along a line 5B—5B in FIG. 5A overlapped by another section taken along a line 7B—7B' in the same figure, showing the sounding apparatus placed on a printed circuit board.

FIG. 5A is a plan view of a hitting type sounding apparatus which is the third embodiment of the present invention with part of a container 102 being broken away for clarity. FIG. 5B is a cross-sectional view showing the sounding apparatus mounted on a printed circuit board 6. FIG. 6 illustrates a bobbin 217 used in the sounding apparatus of FIGS. 5A and 5B. The third embodiment of the present invention will now be described in connection with these figures.

The bobbin 217 is modified to have L-shaped bobbin terminals 215 which can be subjected to, for example, resistance welding, as differed from the bobbin terminals 15 of the bobbin 17 shown in FIG. 3.

The sounding apparatus comprises surface-mounting terminals 205 each of which serves to mount the sounding apparatus 101 on the pattern surface of the printed circuit board 6 in the surface-mounting manner and a pole piece 8 adapted to complete a closed circuit together with a magneticity created as the magnet wire wound about the bobbin 217, which will be described hereinafter, is energized.

The sounding apparatus also comprises a housing 210 which includes openings 229 formed therein at the inner bottom wall and openings 233 formed therein at the outer bobbin wall. At the same time as the bobbin 217 receives the projection of a pole piece 8, each of the openings 229 in the housing 210 receives the corresponding one of protrusions 14 on the bobbin 217 such that each of the surface-mounting terminals 205 will be brought into contact with the corresponding one of the bobbin terminals 215.

As shown in FIG. 5B, each of such contacted sections 230 may be resistance welded by pressurizing and heating it between electrodes 230 and 232. Such an electrical connection may be performed by any other suitable means such as thermocompression bonding or soldering.

The sounding apparatus further comprises a container 102 which holds, at its closed top, a vibrating plate 119 having a permanent magnet 118 and a resonating plate 120. These plates 119 and 120 are maintained spaced apart from each other through spacer means 126. When the magnet wire 11 is energized, a magnetic field is created to actuate the vibrating plate 119 which in turn hits the resonating plate 120 to generate a sound. The sound will be emitted outwardly through sound emitting ports 103 formed in the closed top wall of the container 102.

If only soldering is to be made, the contacted sections 230 may be pressurized and heated simply as by an electric iron. At such a case, the openings 233 may be completely closed to enhance the sealing property.

The container 102 may be the same one as in the second embodiment and joined to the housing 210 in the same manner as in the second embodiment.

In the third embodiment, the openings 229 and 233 in the housing 210 are completely closed by the surface-mounting teminals 205 since it is not required therein that the terminals are passed through these openings from the side on which the coil bobbin 217 is mounted to the opposite side. It is therefore not required to seal the contacted sections 230 in the third embodiment. Such an arrangement is appliable not only to the hitting type sounding apparatus as mentioned above, but also to all types of sounding systems like the speaker type one set forth in said first embodiment.

In the third embodiment, the bobbin terminals 215 may be connected with the surface-mounting terminals 205 by the use of any suitable connecting means such as soldering, resistance welding, connector system or the like.

Although all the embodiments of the present invention have been described as to the constructions of externally-excited type having no drive circuit, the present invention may be also applied to sounding systems of self-exciting type having drive circuits therein.

The sounding apparatus of the present invention thus manufactured can withstand a high temperature equal to about 240° C. and completely sealed from the external circumstances as by a liquid-proof label 22 which is made of a high heat-resistance film having silicone adhesive on the surface thereof for preventing any liquid such as cleaning liquid from entering the interior of the container 2 or the sound emitting ports 3 or 103 thereof. Such a sounding apparatus may be mounted on the printed circuit board 6 as by the use of infra-red soldering and further clenaed by any cleaning liquid together with the printed ciruit board.

Figure 7A:
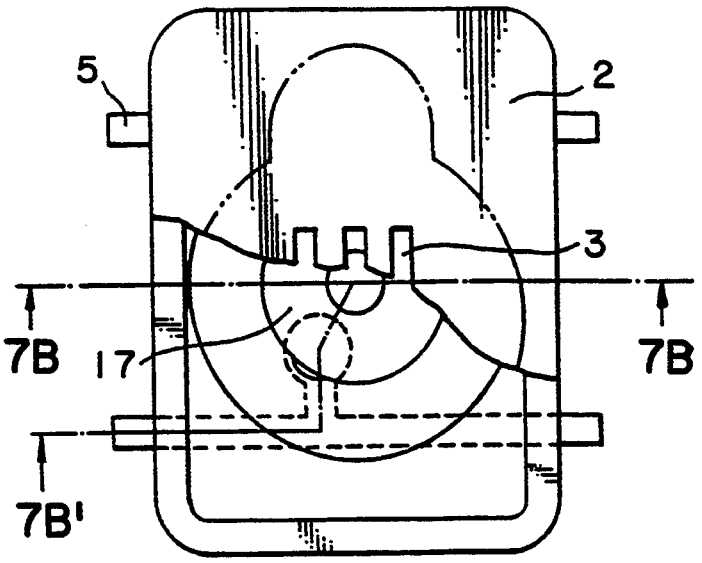
FIG. 7A is a plan view, partially broken away, of a hitting type sounding apparatus which is the fourth embodiment of the present invention.
Figure 7B:
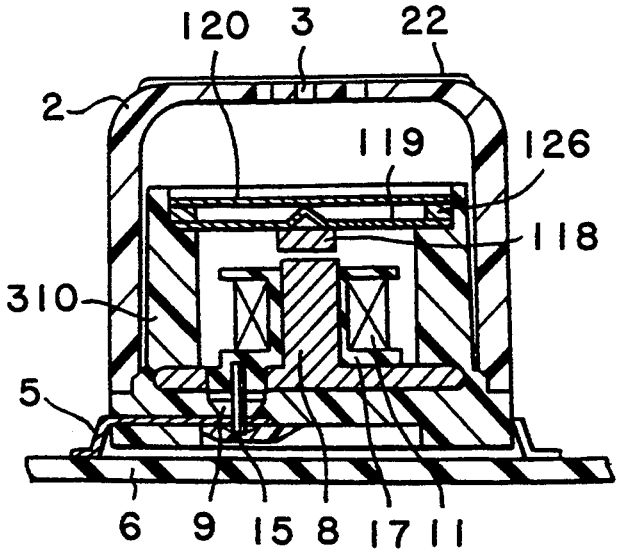
FIG. 7B is a cross-sectional view having a section taken along a line A—A in FIG. 7A overlapped by another section taken along a line 7B' in the same figure, showing the sounding apparatus placed on a printed circuit board.
Figure 7C:
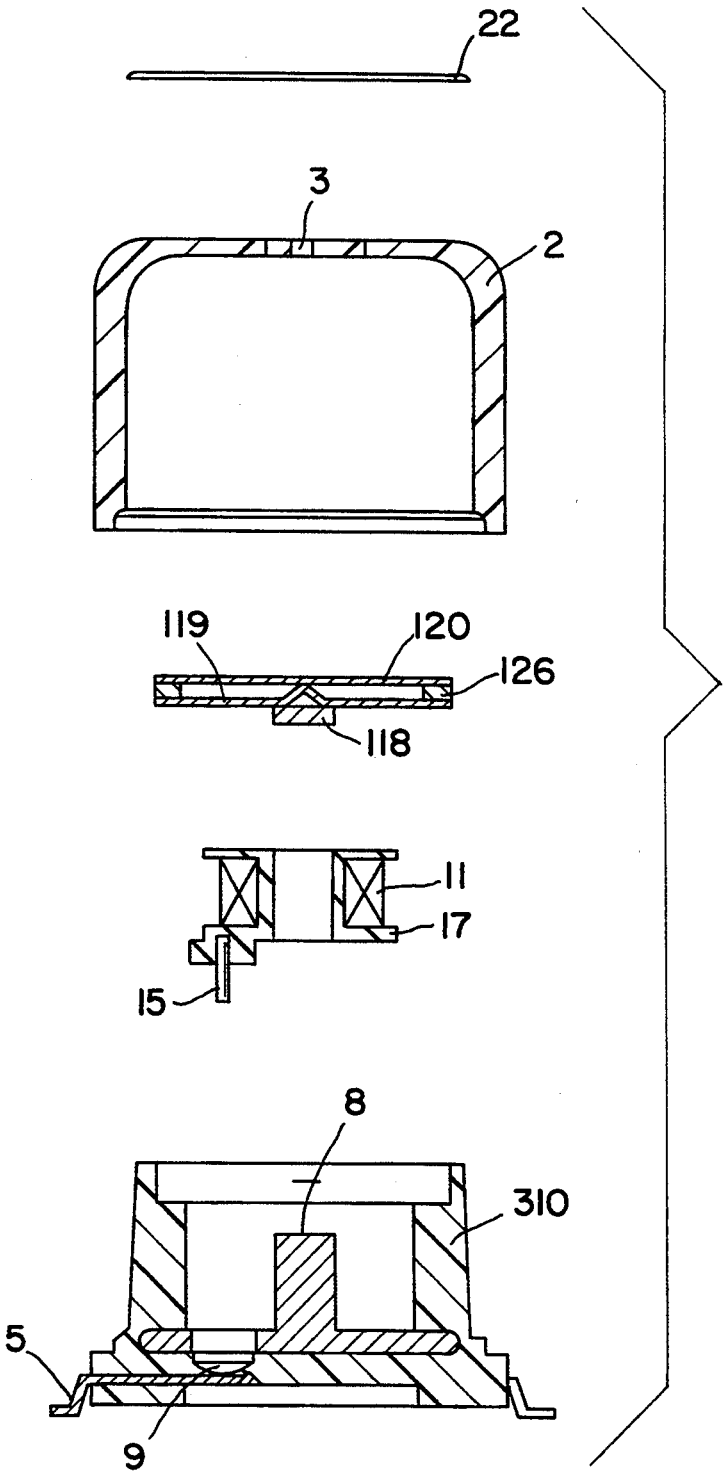
FIG. 7C is an exploded view of the cross-sectional view of the FIG. 7B.

Furthermore, besides such a structure as the vibrating plate 119 and the resonating plate 120 being directly fixed to the container 102 as shown in said second and third embodiments, it is also available to carry the vibrating plate 119 by a supporting portion formed at the inner wall surface near the upper end of the housing 310 whereas the resonating plate 120 being arranged to separately face the vibrating plate 119 with a predetermined space by the spacer 126 inserted therebetween as shown in FIG. 7.

What is claimed is:

1. A sounding apparatus having surface-mounting terminals, terminal surfaces of said surface-mounting terminals being in contact with a conductive pattern surface of a printed circuit board, said terminal surfaces being fixed on said conductive pattern surface by a solder to provide electrical connection, said sounding apparatus comprising:

a pole piece including a flat plate portion having first openings formed thereon, and a projection extending from the center of said flat plate portion;

a bobbin to be fitted around the projection of the pole piece, including magnet wire wound between flanges of said bobbin, protrusions formed on one of said flanges to be inserted into said first openings, and bobbin terminals extending through said protrusions and thereby being electrically connected with terminations of said magnet wire;

said surface-mounting terminals having holes through which each of said bobbin terminals extends, said holes being arranged so as to align with said first openings of said pole piece;

a molded plastic housing with said surface-mounting terminals laterally passing therethrough and partially extending from the side surfaces thereof, and said pole piece fixed inside thereof by plastic molding, said molded plastic housing firmly holding the flat plate portion of said pole piece on a top surface of a base thereof, fixedly supporting said surface-mounting terminals, having second openings formed thereon at positions corresponding to said first openings of said pole piece and said hole of said surface-mounting terminals, and having a recess on a rear surface of said base, wherein a portion of said surface mounting terminals including said hole and its surroundings is exposed in said second openings and said recess so that said bobbin terminals and said surface-mounting terminals are electrically connected in said recess.

2. A sounding apparatus as defined in claim 1, wherein said molded plastic housing includes a cylindrical support portion integrally formed thereon, and houses, in said cylindrical support portion, a cylindrical magnet with an open end thereof in contact with said flat plate portion of said pole piece.

3. A sounding apparatus as defined in claim 2, wherein said cylindrical support portion includes projections on an inner surface thereof to support a vibrating plate with a space kept against said pole piece.

4. A sounding apparatus as defined in claim 3, wherein said molded plastic housing holds a resonant plate producing sound by striking force caused by vibrations of said vibrating plate.

5. A sounding apparatus as defined in claim 1 further including a container attached to said molded plastic housing to cover a side thereof, said container constituting a sound resonating space.

6. A sounding apparatus as defined in claim 5, wherein said container holds, on an inner ceiling thereof, a vibrating plate vibrating by a magnetic force of said pole piece, and a resonant plate producing sound by striking force caused by vibrations of said vibrating plate.

* * * * *